US009234674B2

(12) United States Patent
Hayden et al.

(10) Patent No.: US 9,234,674 B2
(45) Date of Patent: Jan. 12, 2016

(54) NEXT GENERATION BARE WIRE WATER HEATER

(71) Applicant: EEMAX, INC., Waterbury, CT (US)

(72) Inventors: Chris Hayden, Shelton, CT (US); Eric R. Jurczyszak, Berlin, CT (US); Jeff Hankins, Southbury, CT (US)

(73) Assignee: EEMAX, INC., Waterbury, CT (US)

( * ) Notice: Subject to any disclaimer, the term of this patent is extended or adjusted under 35 U.S.C. 154(b) by 0 days.

(21) Appl. No.: 13/835,346

(22) Filed: Mar. 15, 2013

(65) Prior Publication Data

US 2014/0178057 A1 Jun. 26, 2014

Related U.S. Application Data

(60) Provisional application No. 61/740,653, filed on Dec. 21, 2012.

(51) Int. Cl.
*F24H 1/10* (2006.01)
*F24H 1/14* (2006.01)
(Continued)

(52) U.S. Cl.
CPC ..... *F24H 1/142* (2013.01); *F24H 9/1818* (2013.01); *F24H 9/2014* (2013.01); *H05B 3/16* (2013.01); *H05B 3/46* (2013.01); *F24H 2250/02* (2013.01)

(58) Field of Classification Search
CPC . G01N 2201/068; G01N 33/18; G01H 9/004; G01H 9/00; G01H 3/00; B01L 3/502715; B01L 2300/0654; B01L 3/5027; B01L 2200/027; B01L 2300/0627; H01L 21/67248; H01L 21/67103; H01L 21/67109; H01L 21/67115; H01L 23/345; H01L 23/473; F24H 1/121; F24H 1/0018; F24H 1/102; F24H 1/142; F24H 3/002; F24H 9/00; F24H 9/2028; F24H 2250/02; F24H 9/1818; F24H 9/2014; G01L 3/08; G01L 3/12; H05B 3/06; H05B 3/58; H05B 1/0252; H05B 1/0269; H05B 2203/016; H05B 2203/021; H05B 37/02; H05B 37/0218; H05B 37/0227; H05B 3/008; H05B 3/023; H05B 3/22; H05B 3/24; H05B 3/82; H05B 6/645; H05B 6/64; H05B 3/16; H05B 3/46; H02G 3/06
USPC ..... 422/82.05; 392/480; 73/653, 655, 73/862.324, 862.624, 54.08; 219/502; 16/22, 23, 27, 89, 90, 109, 420
See application file for complete search history.

(56) References Cited

U.S. PATENT DOCUMENTS 270,478 A * 1/1883 Pumphrey ..... 403/206
601,585 A * 3/1898 McElroy ..... 338/57
(Continued)

FOREIGN PATENT DOCUMENTS

CN 201844531 5/2011
DE 197 26 288 A 1 6/1997
JP 11-148716 6/1999

OTHER PUBLICATIONS

DE 197 26 288 A1 Machine Translation.*
(Continued)

*Primary Examiner* — Eric Stapleton
(74) *Attorney, Agent, or Firm* — Oblon, McClelland, Maier & Neustadt, L.L.P.

(57) ABSTRACT

A heating unit for heating fluid is described having at least one electrical resistance heating element on an outer surface of a tube. At least one indexed groove is provided around a surface of the tube allowing for at least one retention clip to hold the electrical resistance heating element. A heating chamber is also provided to enclose a portion of the tube and to provide a flow channel therebetween. The heating chamber includes an optical sensor to detect overheating of the at least one electrical resistance heating element. Fluid is heated by flowing over the surface of the at least one electrical resistance heating element and through the tube.

23 Claims, 6 Drawing Sheets

(51) Int. Cl.

| | |
|---|---|
| ***F24H 9/18*** | (2006.01) |
| ***F24H 9/20*** | (2006.01) |
| ***H05B 3/16*** | (2006.01) |
| ***H05B 3/46*** | (2006.01) |

(56) References Cited

U.S. PATENT DOCUMENTS

| | | | | | |
|---|---|---|---|---|---|
| 1,718,970 | A | * | 7/1929 | Lonergan | 392/489 |
| 1,729,483 | A | * | 9/1929 | Koch | 285/148.1 |
| 1,777,744 | A | * | 10/1930 | Breuer | 392/384 |
| 1,821,525 | A | * | 9/1931 | Nielsen | 392/385 |
| 1,851,851 | A | * | 3/1932 | Lee et al. | 122/166.1 |
| 2,032,416 | A | * | 3/1936 | Hunt | 285/323 |
| 2,041,687 | A | * | 5/1936 | Benson | 392/385 |
| 2,224,422 | A | * | 12/1940 | Ballman | 318/785 |
| 2,360,019 | A | * | 10/1944 | Ryan et al. | 403/44 |
| 2,576,298 | A | * | 11/1951 | Kessler | 403/247 |
| 2,589,566 | A | * | 3/1952 | Neth et al. | 392/479 |
| 2,681,409 | A | * | 6/1954 | Dobbins | 392/408 |
| 2,730,609 | A | * | 1/1956 | Constantinesco | 392/476 |
| 2,824,199 | A | * | 2/1958 | Browne | 338/241 |
| 2,996,316 | A | * | 8/1961 | Terhune | 285/4 |
| 3,088,017 | A | * | 4/1963 | Schomann | 392/494 |
| 3,108,174 | A | * | 10/1963 | Hynes | 392/485 |
| 3,310,769 | A | * | 3/1967 | Simmons | 338/241 |
| 3,313,921 | A | * | 4/1967 | Mohn et al. | 219/553 |
| 3,329,455 | A | * | 7/1967 | Becker et al. | 403/76 |
| 3,512,114 | A | * | 5/1970 | Dzaack | 338/241 |
| 3,625,549 | A | * | 12/1971 | De Vries | 285/39 |
| 3,633,748 | A | * | 1/1972 | Hanley et al. | 210/97 |
| 3,921,505 | A | * | 11/1975 | Wunsch | 92/169.1 |
| 3,977,073 | A | * | 8/1976 | Shirey | 29/611 |
| 4,056,143 | A | * | 11/1977 | Martin | 165/176 |
| 4,242,775 | A | * | 1/1981 | Eickmann | 24/16 R |
| 4,250,399 | A | * | 2/1981 | King | 219/532 |
| 4,270,367 | A | * | 6/1981 | Santore | 464/169 |
| 4,338,888 | A | * | 7/1982 | Gerstmann et al. | 122/18.4 |
| 4,439,669 | A | * | 3/1984 | Ryffel | 392/320 |
| 4,460,201 | A | * | 7/1984 | McGugan | 285/18 |
| 4,600,334 | A | * | 7/1986 | Soussloff | 403/369 |
| 4,682,578 | A | * | 7/1987 | Schmidt | 126/91 R |
| 4,762,980 | A | * | 8/1988 | Insley | 392/494 |
| 4,775,258 | A | * | 10/1988 | Lange | 403/171 |
| 4,808,793 | A | * | 2/1989 | Hurko | 392/489 |
| 4,813,992 | A | * | 3/1989 | Hale | 65/140 |
| 4,835,365 | A | * | 5/1989 | Etheridge | 392/489 |
| 4,885,840 | A | * | 12/1989 | McManus | 29/611 |
| 4,892,432 | A | * | 1/1990 | Cooper | 403/297 |
| 5,122,640 | A | * | 6/1992 | Holmes | 219/532 |
| 5,124,534 | A | * | 6/1992 | Williams et al. | 219/532 |
| RE34,018 | E | * | 8/1992 | Petersen et al. | 338/303 |
| 5,243,185 | A | * | 9/1993 | Blackwood | 250/225 |
| 5,269,572 | A | * | 12/1993 | Mefferd | 285/330 |
| 5,293,446 | A | * | 3/1994 | Owens et al. | 392/449 |
| 5,308,207 | A | * | 5/1994 | Jaskowiak | 411/513 |
| 5,325,822 | A | * | 7/1994 | Fernandez | 392/491 |
| 5,384,032 | A | * | 1/1995 | de Souza | 210/104 |
| 5,400,432 | A | * | 3/1995 | Kager et al. | 392/492 |
| 5,549,078 | A | * | 8/1996 | Annecharico et al. | 392/398 |
| 5,559,924 | A | * | 9/1996 | Kadotani et al. | 392/483 |
| 5,628,895 | A | * | 5/1997 | Zucholl | 210/85 |
| 5,740,315 | A | * | 4/1998 | Onishi et al. | 392/489 |
| 5,772,355 | A | * | 6/1998 | Ross et al. | 403/322.1 |
| 5,897,269 | A | * | 4/1999 | Ross et al. | 403/322.1 |
| 5,930,458 | A | * | 7/1999 | Yane et al. | 392/482 |
| 5,959,254 | A | * | 9/1999 | Martin, Sr. | 174/138 J |
| 5,995,711 | A | * | 11/1999 | Fukuoka et al. | 392/347 |
| 6,005,225 | A | * | 12/1999 | Kowalski et al. | 219/390 |
| 6,020,577 | A | * | 2/2000 | Barker | 219/537 |
| 6,055,360 | A | * | 4/2000 | Inoue et al. | 392/485 |
| 6,091,890 | A | * | 7/2000 | Gruzdev et al. | 392/485 |
| 6,097,007 | A | * | 8/2000 | Wang | 219/501 |
| 6,157,778 | A | * | 12/2000 | Kadotani | 392/483 |
| 6,199,515 | B1 | * | 3/2001 | Clarke | 122/4 R |
| 6,231,194 | B1 | * | 5/2001 | Raj et al. | 353/122 |
| 6,236,810 | B1 | * | 5/2001 | Kadotani | 392/485 |
| 6,252,220 | B1 | * | 6/2001 | Jedlicka et al. | 250/208.1 |
| 6,259,070 | B1 | * | 7/2001 | Audet | 219/461.1 |
| 6,297,740 | B1 | * | 10/2001 | Hill et al. | 340/600 |
| 6,509,554 | B2 | * | 1/2003 | Howard et al. | 219/536 |
| 6,593,553 | B2 | * | 7/2003 | Whitfield | 219/536 |
| 6,909,843 | B1 | * | 6/2005 | Fabrizio | 392/490 |
| 7,007,316 | B2 | * | 3/2006 | Lutz, II | 4/620 |
| 7,046,922 | B1 | * | 5/2006 | Sturm et al. | 392/482 |
| 7,156,425 | B2 | * | 1/2007 | Atkinson | 285/133.4 |
| 7,293,914 | B2 | * | 11/2007 | Wang | 374/141 |
| 7,324,746 | B2 | * | 1/2008 | Tanaka et al. | 392/465 |
| 7,592,572 | B2 | * | 9/2009 | Schlipf | 219/532 |
| 7,593,625 | B2 | * | 9/2009 | Kamikawa et al. | 392/393 |
| 7,668,444 | B2 | * | 2/2010 | Tsai | 392/407 |
| 7,857,002 | B2 | * | 12/2010 | Reck | 137/625.47 |
| 7,972,077 | B2 | * | 7/2011 | Kim | 403/64 |
| 8,104,434 | B2 | * | 1/2012 | Fabrizio | 122/40 |
| 8,165,461 | B2 | * | 4/2012 | Sullivan | 392/485 |
| 8,280,236 | B2 | * | 10/2012 | Fabrizio | 392/490 |
| 8,426,779 | B2 | * | 4/2013 | Schlipf | 219/481 |
| 2002/0008970 | A1 | * | 1/2002 | Hanson et al. | 362/186 |
| 2003/0026603 | A1 | * | 2/2003 | Castaneda et al. | 392/483 |
| 2004/0051313 | A1 | * | 3/2004 | Trouyet | 285/305 |
| 2004/0069517 | A1 | * | 4/2004 | Olson | 174/49 |
| 2004/0098831 | A1 | * | 5/2004 | Elmer | 16/89 |
| 2005/0072103 | A1 | * | 4/2005 | Hopwood | 52/633 |
| 2006/0168756 | A1 | * | 8/2006 | Sato et al. | 16/22 |
| 2006/0215178 | A1 | * | 9/2006 | Seko et al. | 356/614 |
| 2006/0222349 | A1 | * | 10/2006 | Sturm et al. | 392/463 |
| 2007/0017265 | A1 | * | 1/2007 | Andersson | 70/379 R |
| 2007/0023418 | A1 | * | 2/2007 | Schlipf | 219/532 |
| 2008/0028512 | A1 | * | 2/2008 | Hughson | 4/541.3 |
| 2008/0274823 | A1 | * | 11/2008 | Lindner | 473/297 |
| 2009/0025399 | A1 | * | 1/2009 | Kamen et al. | 62/6 |
| 2009/0034947 | A1 | * | 2/2009 | Tsai | 392/407 |
| 2010/0068123 | A1 | * | 3/2010 | Edwin et al. | 423/447.2 |
| 2010/0086289 | A1 | * | 4/2010 | Johnson et al. | 392/490 |
| 2010/0093205 | A1 | * | 4/2010 | Stone et al. | 439/352 |
| 2010/0126108 | A1 | * | 5/2010 | Andrikopoulos | 52/741.1 |
| 2010/0212752 | A1 | * | 8/2010 | Fima | 137/87.03 |
| 2011/0203781 | A1 | * | 8/2011 | Ellingwood et al. | 165/173 |
| 2011/0233191 | A1 | * | 9/2011 | Gubler et al. | 219/546 |
| 2011/0240269 | A1 | * | 10/2011 | Mackenzie | 165/141 |
| 2011/0318090 | A1 | * | 12/2011 | Lai | 403/27 |
| 2012/0055917 | A1 | * | 3/2012 | Kimmins et al. | 219/488 |
| 2012/0275775 | A1 | * | 11/2012 | Iskrenovic | 392/483 |
| 2013/0034344 | A1 | * | 2/2013 | Lutz et al. | 392/449 |
| 2013/0156492 | A1 | * | 6/2013 | Maier | 403/109.7 |
| 2014/0023352 | A1 | * | 1/2014 | Jurczyszak et al. | 392/466 |
| 2014/0023354 | A1 | * | 1/2014 | Hankins et al. | 392/480 |

OTHER PUBLICATIONS

International Search Report issued Jun. 5, 2013 in PCT/US13/32298 filed Mar. 15, 2013.

International Written Opinion issued Jun. 5, 2013 in PCT/US13/32298 filed Mary 15, 2013.

International Search Report issued Jan. 3, 2014, in PCT/US2013/050897, filed Jul. 17, 2013.

Written Opinion of the International Searching Authority dated Jan. 3, 2014, in PCT/US2013/050897, filed Jul. 17, 2013.

Office Action mailed Apr. 24, 2015, in co-pending U.S. Appl. No. 13/943,495.

* cited by examiner

NEXT GENERATION BARE WIRE WATER HEATER

CROSS REFERENCE TO RELATED APPLICATIONS

This Application is based upon and claims the benefit of priority from the U.S. Provisional Application No. 61/740,653, filed on Dec. 21, 2012, the entire contents of which are incorporated herein by reference.

BACKGROUND

There are a variety of methods for heating fluid. One method involves the user of an electrically charged bare wire to heat fluids passing over the bare wire. As fluid in this method is passed directly over the bare wire itself, the water is heated at an extremely high rate. However, bare wire elements are susceptible to damage when dry fired or operated under low pressure. In other words, fluid must be continually present and flowing using bare wires systems as the presence of air gaps or stagnant water for a period of time can damage the bare wire and associated heating system due to overheating.

To detect overheating, many systems use mechanical thermostats to identify the temperature inside of a heating chamber. However, this approach is limited by the time it takes for heat to transfer through all materials within the heating system especially with the presence of stagnant water or gas pockets. This lengthened reaction time significantly increases the chances of damage to the heating unit and instability to the system as a whole.

SUMMARY OF ILLUSTRATIVE EMBODIMENTS

A heating unit for heating fluid is described having at least one electrical resistance heating element on an outer surface of a tube. At least one indexed groove is provided around a surface of the tube allowing for at least one retention clip to hold the electrical resistance heating element. A heating chamber is also provided to enclose a portion of the tube and to provide a flow channel therebetween. The heating chamber includes an optical sensor to detect overheating of the at least one electrical resistance heating element. Fluid is heated by flowing over the surface of the at least one electrical resistance heating element and through the tube.

The details of one or more implementations are set forth in the accompanying drawing and description below. Other features, objects, and advantages will be apparent from the description and drawings, and from the claims.

BRIEF DESCRIPTION OF FIGURES

Like reference symbols in various drawing indicate like elements.

DETAILED DESCRIPTION OF THE ILLUSTRATIVE EMBODIMENTS

Figures 1A, 1B, 1C:
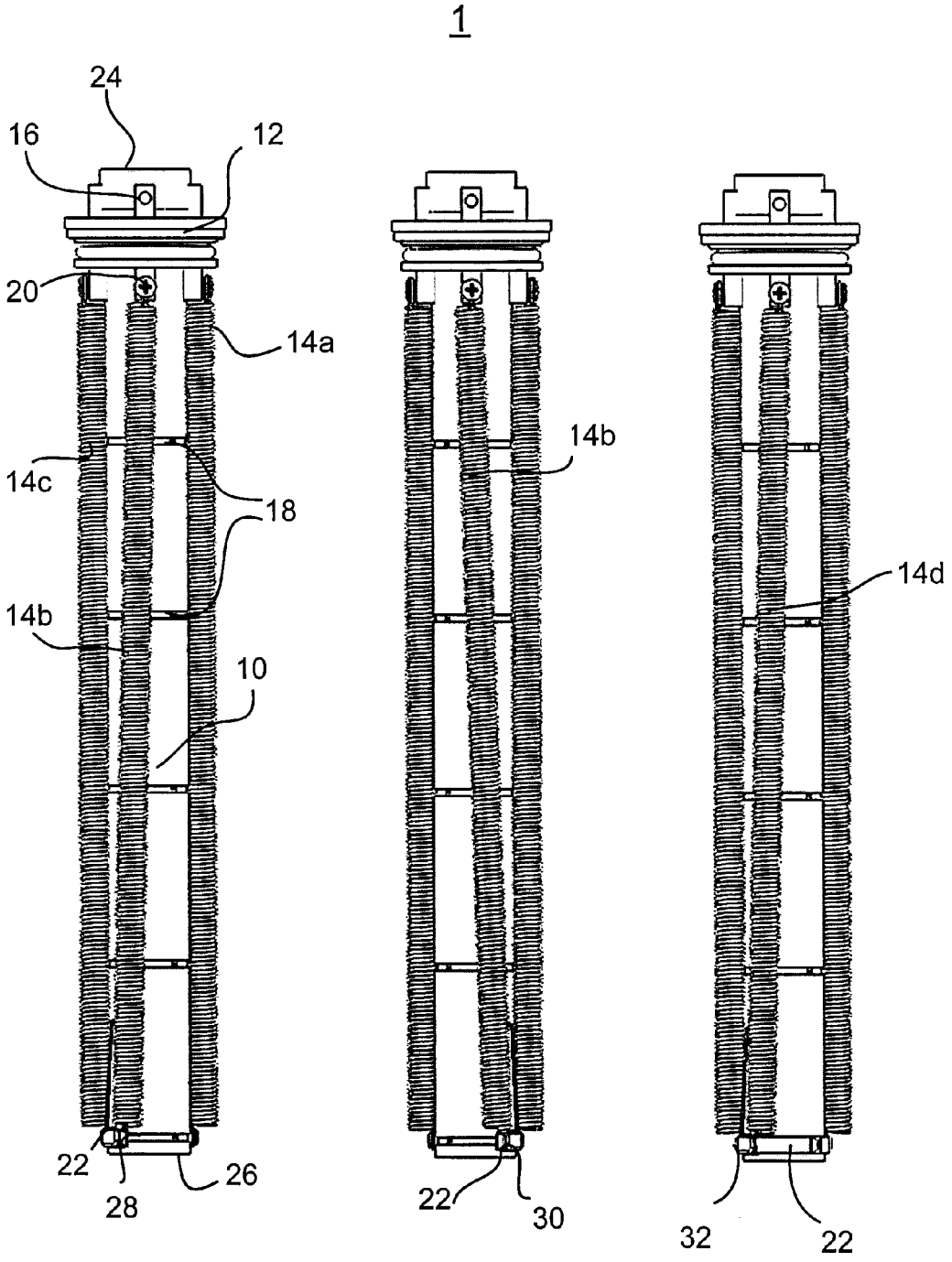
FIG. 1A is a side view of a heating unit according to one example.
FIG. 1B is a side view of the heating unit according to one example.
FIG. 1C is a side view of the heating unit according to one example.

Selected embodiments are now described by referring now to the drawings, wherein like reference numerals designate identical or corresponding parts throughout the several views. It is noted that as used in the specification and the appending claims, the singular forms "a," "an," and "the" can include plural references unless the context clearly dictates otherwise.

FIGS. 1A-1C illustrate a heating unit 1 according to an exemplary embodiment. In FIG. 1A, the heating unit 1 includes a tube 10 having a cylindrical shape with a flange 12 at one end. The flange 12 provides a connection point to external components with respect to an outlet 24 of the tube. The tube 10 is molded or machined to have at least one indexed groove 18 around a circumference of the tube 10. The at least one indexed groove 18 is a recess provided in the tube 10 which runs continuously around the circumference of the tube 10. In selected embodiments, the tube 10 will have a plurality of any number of indexed grooves 18 located at predetermined intervals along the body of the tube 10 with respect to a length of the tube 10 as illustrated in FIGS. 1A-1C. The indexed grooves 18 may be machined or molded at equal distances from each other based on the length of the tube 10 or may be machined or molded at preset positions along the length of the tube 10. Additionally, the tube 10 has an inlet 26 through which fluids may be transmitted through the tube 10.

The tube 10 is molded or machined to act as a supporting structure for at least one electrical resistance heating element 14 which runs the length of the tube 10. In selected embodiments and as illustrated in FIGS. 1A-1C, the heating unit 1 may comprise a plurality of electrical resistance heating elements 14*a*-14*d*. Each electrical resistance heating element 14 is mechanically connected to the tube 10 via a termination connector 16 which extends through the flange 12 and at least one retention clip 22 provided on one of the indexed grooves 18. The termination connector 16 includes at least one hole so that a fastening device 20, such as a screw, can be used to affix the electrical resistance heating element 14 to the tube 10. In selected embodiments, the termination connector 16 may be a single component or two separate components attached to either side of the flange 12. Electricity is externally applied to the electrical resistance heating elements 14 from an external source, such as an electrical circuit, via the termination connector 16. In selected embodiments and as illustrated in FIGS. 1A-1C, the heating unit 1 will include a single retention clip 22 to which one or more of the electrical resistance heating elements 14 are connected. However, multiple retention clips 22 can be provided within one or more of the indexed grooves 18 thereby providing multiple connection points for one or more electrical resistance heating elements 14. Further, retention clip 22 can be molded or machined as part of the tube 10 or can be a separate component which is removable from the tube 10.

The retention clips 22 are formed to provide pivot points for the electrical resistance heating elements 14 connected thereto. In other words, the retention clips 22 can be linearly adjusted along the indexed grooves 18 at which the retention clip is located to linearly adjust the location of the placement of the electrical resistance heating elements 14 on the surface of the tube 10. For example, in FIG. 1A, the electrical resistance heating element 14*b* is illustrated as connected to the retention clip 22 at a first position 28 along the bottom of the tube 10. The first position 28 is determined based on the adjustment of the retention clip 22 within the indexed groove 18. In FIG. 1B, however, it can be seen that the electrical resistance heating element 14*b* is located at a second position 30 based on the linear adjustment of the retention clip 22 within the indexed groove 18. Further, FIG. 1C illustrates the opposite side of the tube 10 with respect to FIGS. 1A and 1B and illustrates a first position 32 of the electrical resistance heating element 14*d* at the bottom of the tube 10 based on the linear adjustment of the retention clip 22.

The ability to linearly adjust the electrical resistance heating elements 14 within an indexed groove 18 via the retention clip provides numerous advantageous. For example, each system in which the heating unit 1 is applied can be tested to determine the best heat transfer properties based on the particularities of the system such that the position of the electrical resistance heating elements 14 can be adjusted to maximize heat transfer within that system. Further, should the heat transfer characteristics change at some point, the locations of the electrical resistance heating elements 14 of the heating unit 1 can easily be modified to compensate for this change.

Figure 2A:
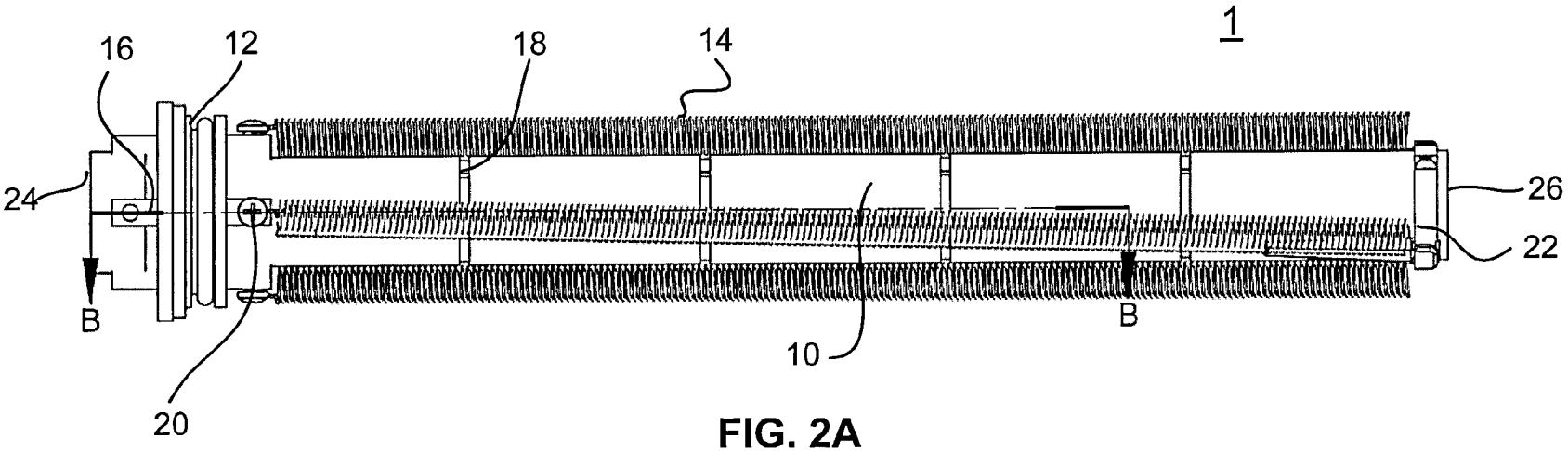
FIG. 2A is a side view of the heating unit identifying a cross-section according to one example.
Figure 2B:
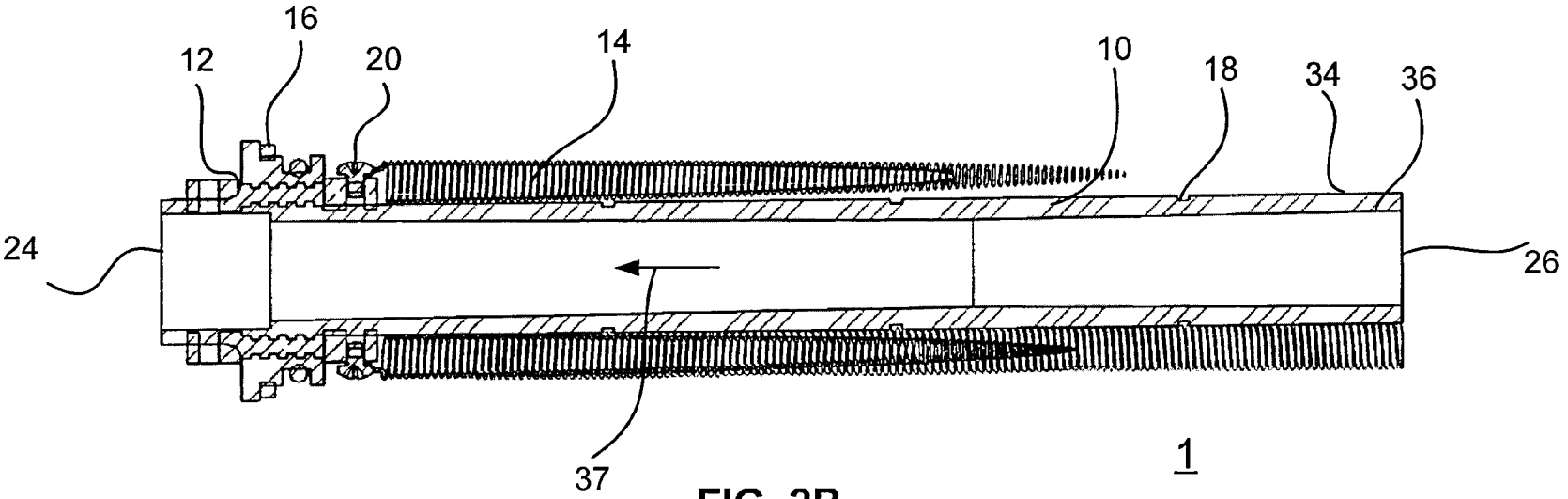
FIG. 2B is a cross-sectional view of the heating unit of FIG. 3A according to one example.

FIG. 2A illustrates a side view of the heating unit 1 according to an exemplary embodiment. Like designations are repeated and therefore the heating unit 1 provides a tube 10 having an inlet 26 and an outlet 24. The heating unit 1 further includes a flange 12, termination connection 16, indexed grooves 18, a retention clip 22 and electrical resistance heating elements 14. FIG. 2B illustrates a cross sectional view of the heating unit 1 of FIG. 2A cut across the segment "B" illustrated in FIG. 2A.

As illustrated in FIG. 2B, the heating unit 1 has a termination connector 16, flange 12, fastening device 20 and electrical resistance heating elements 14. FIG. 2B also clearly illustrates the indexed grooves 18 running around a circumference of an outer surface of the tube 10. As previously described herein, the indexed grooves 18 are recesses in an outer surface of the tube 10. The depth of the recesses of the indexed grooves 18 can be any amount of displacement from the outer surface 34 of the tube 10 to an inner surface 36 of the tube 10. As illustrated in FIG. 2B, the indexed grooves 18 are machined or molded in a straight circular continuous fashion around the circumference of the tube 10. However, in other selected embodiments, the indexed grooves 18 may be machined or molded in different shapes around the circumference of the tube 10 such that the retention clip 22 can be adjusted in various directions with respect to the length of the tube 10. Further, in selected embodiments, the tube 10 may be machined or molded to contain different combinations of the above-described indexed grooves 18. FIG. 2B also illustrates a fluid flow path 37 through which fluids flow from the inlet 26 through the tube 10 to the outlet 24. The fluid flowing into the tube 10 is fluid that has been heated by flowing over the electrical resistance heating elements 14 and/or fluid that is heated by passing through the tube 10 which is heated from the exterior by the electrical resistance heating elements 14.

Figure 3B:
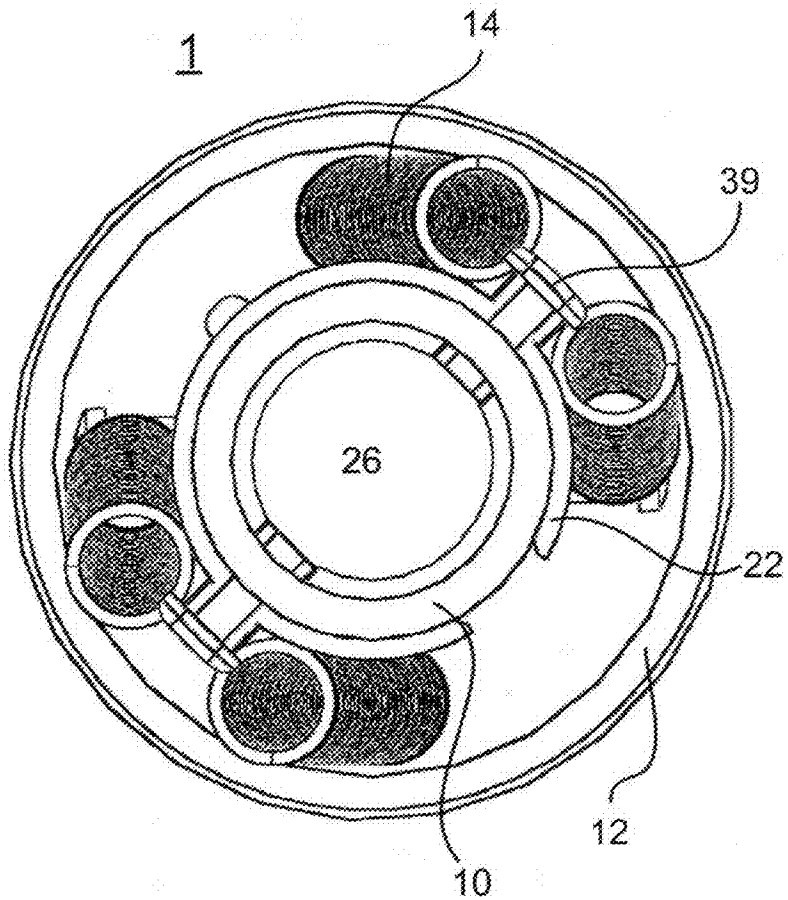
FIG. 3B is a bottom view of the heating unit according to one example.
Figure 3A:
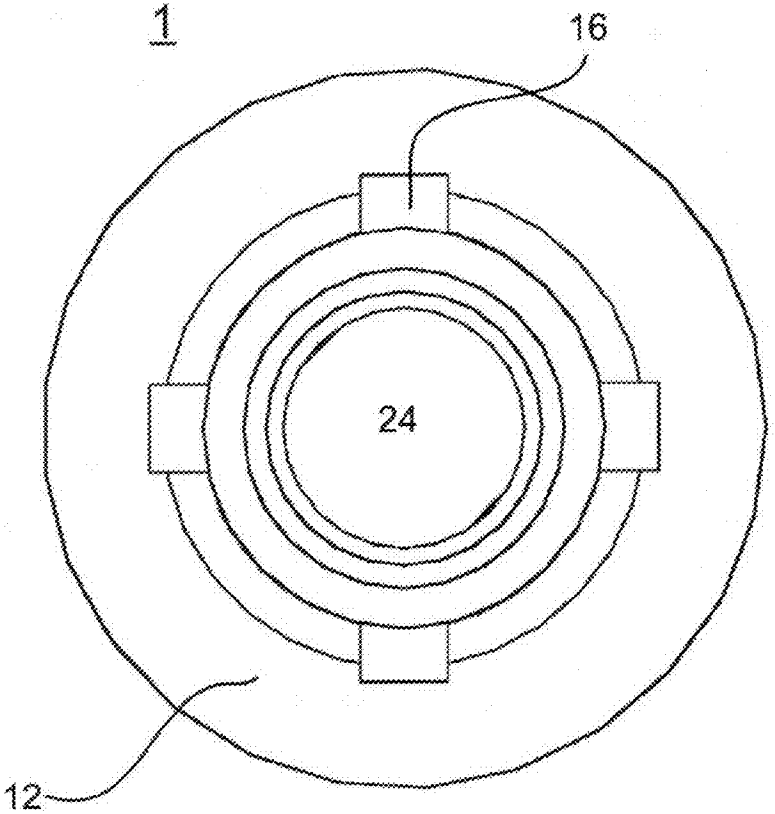
FIG. 3A is a top view of the heating unit according to one example.

FIG. 3A illustrates a top view of the heating unit 1 according to an exemplary embodiment. As illustrated in FIG. 3A, there is a top view of the flange 12 having the plurality of termination connections 16 for mechanically and electrically attaching each respective electrical resistance heating element 14. FIG. 3A further illustrates an exemplary fluid flow direction coming out of the tube 10 via outlet 24. FIG. 3B illustrates a bottom view of the heating element according to an exemplary embodiment. As illustrated in FIG. 3B, there is a bottom view of the flange 12 and the tube 10. A plurality of electrical resistance heating elements 14 are attached to the retention clip 22 which is placed over and/or within an indexed groove 18 (not visible due to angle) of the tube 10. In selected embodiments, the electrical resistance heating elements 14 are attached to the retention clip 22 via at least one hook 39 of the retention clip 22. The hook 39 may in selected embodiments be covered with a shielding element in order to prevent damage from heat emanating from connected electrical resistance heating elements 14. As the retention clip 22 is removable in selected embodiments, the retention clip 22 is not required to fully extend around the circumference of the tube 10. However, in selected embodiments the retention clip 22 may fully extend around the tube 10. FIG. 3B also illustrates an exemplary fluid flow direction going into the tube via inlet 26.

Figure 4A:
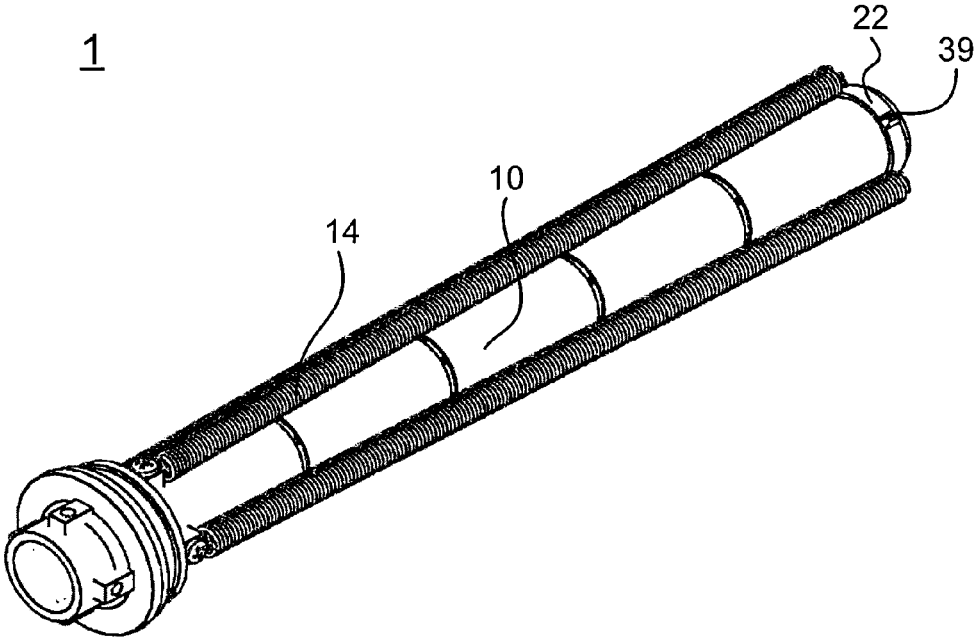
FIG. 4A is a perspective view of the heating unit according to one example.
Figure 4B:
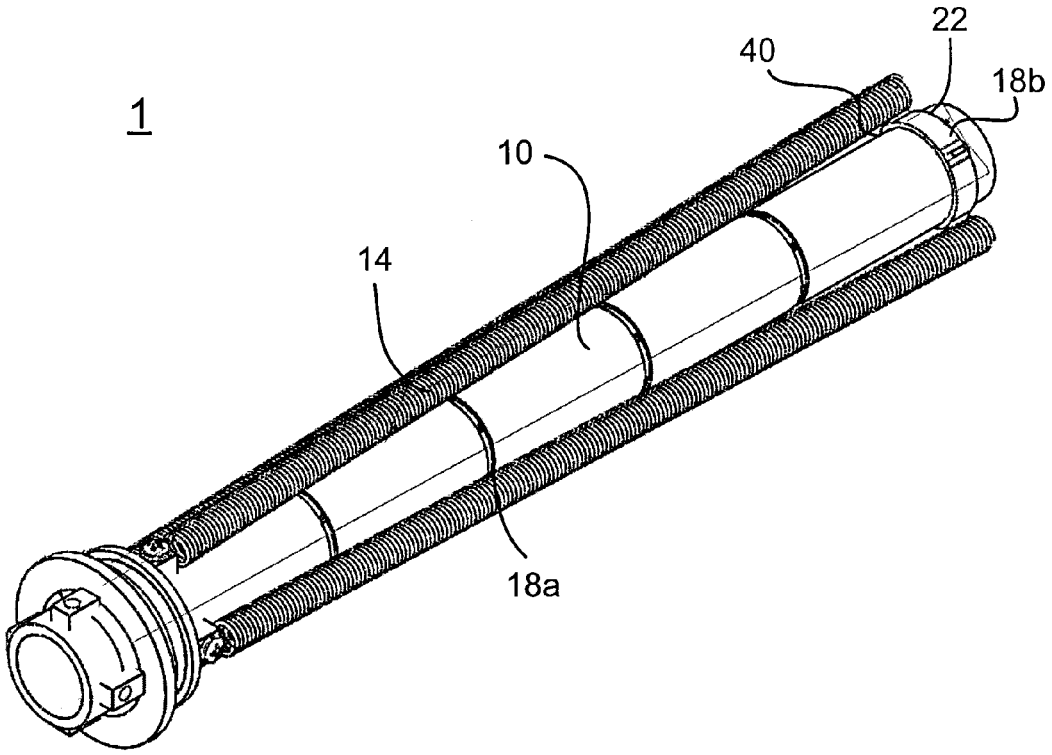
FIG. 4B is a perspective view of the heating unit according to one example.

FIG. 4A illustrates a perspective view of the heating unit 1 according to an exemplary embodiment. In FIG. 4A, it can be seen that the electrical resistance heating elements 14 are positioned along a length of the surface of the tube 10 up until a connection with the retention clip 22. Therefore, as illustrated in FIG. 2B, the electrical resistance heating elements 14 are positioned on the surface of the tube 10. However, alternatively or in addition to, electrical resistance heating elements 14 may be suspended away from the surface of the tube by using the retention clip 22 as a support structure as illustrated in FIG. 4B. In this instance, the electrical resistance heating element 14 is attached to the retention clip 22 via the hook 39 raised from a surface of the retention clip 22. Accordingly, as illustrated in FIG. 4B, by using the retention clip 22 as a support structure, there is a gap 40 between a surface of the tube 10 and a surface of the electrical resistance heating element 14. Further, in selected embodiments, each electrical resistance heating element 14 can be raised off a surface of the tube 10 by using the retention clip 22 as support structure in a similar fashion. Further, additional retention clips 22 may be provided at various indexed grooves 18 thereby providing for gaps between the surface of the tube 10 and a surface of the electrical resistance heating elements 14 at various locations along the length of the tube 10. For example, in selected embodiments, a first retention clip (not shown) could be provided at a first indexed groove 18*a* and the retention slip 22 could be placed at a second indexed groove 18*b* (as illustrated) thereby raising an entirety of the electrical resistance heating element 14 off the surface of the tube 10 and providing a large gap for enhanced fluid flow therebetween.

The use of retention clips 22 as a support structures to provide a gap between a surface of the tube 10 and the surface of the electrical resistance heating elements 14 provides various advantages. For instance, by using the retention clips in this fashion, there will be an increased fluid flow over the electrical resistance heating elements 14 thereby providing an enhanced cooling effect that lowers the risk of burnout or damage to the electrical resistance heating elements 14. Further, connecting the electrical resistance heating elements 14 to the retention clip 22 in this fashion provides for a predetermined amount of tension of the electrical resistance heating elements 14 thereby preventing sag or looseness of the electrical resistance heating elements 14. Alternatively, or in addition, the indexed grooves 18 themselves could be molded or machined such that they are raised above the surface of the tube 10 thereby providing a support structure on which to raise the electrical resistance heating elements 14 above a surface of the tube 10. Retention clips 22 could then be used on the raised indexed grooves 18 to adjust the position of the electrical resistance heating elements 14 as previously described herein.

Figure 5B:
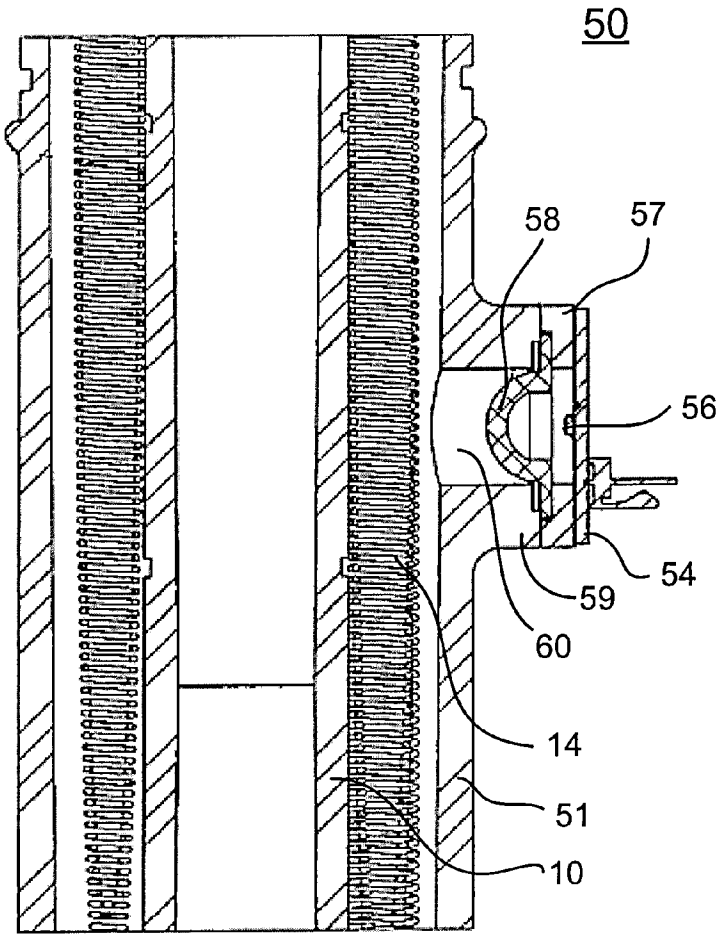
FIG. 5B is a cross sectional view of the heating chamber of FIG. 5A having an optical assembly according to one example.
Figure 5A:
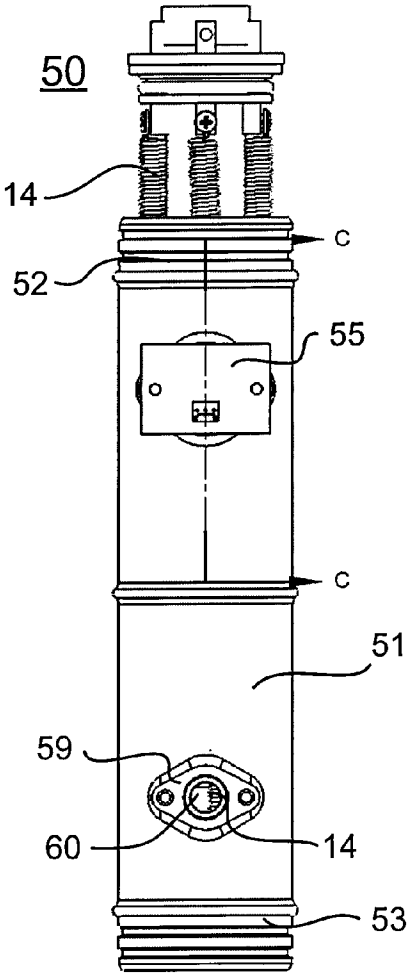
FIG. 5A is a side view of a heating chamber in relation to the heating unit according to one example.

FIG. 5A illustrates a heating system 50 comprising a heating chamber 51 that partially encloses the heating unit 1 according to an exemplary embodiment. As illustrated in FIG. 5A, the heating chamber 51 includes a first connecting portion 52 for connecting to external components. The heating chamber 51 also includes a second connecting portion 53 for connecting to other parts external to the heating system 50. The heating chamber 51 further includes at least one connection port 59 having an opening 60 through which at least one electric resistive heating elements 14 is visible. In other words, the heating chamber 51 is molded or machined such that it includes at least one opening 60 to the components of the heating unit 1 when the heating unit is enclosed by the heating chamber 51. FIG. 5A further illustrates an optical assembly 55 affixed to the opening 60 of the connection port 59. It is noted that in selected embodiments, the heating chamber 51 may include a plurality of connection ports 59 having corresponding openings 60 as well as one or more corresponding optical assemblies 55.

FIG. 5B illustrates a cross sectional view of the heating system 50 along a cross section cut identified by the letter "C" in FIG. 5A. In FIG. 5B, the connection port 59 provides an opening 60 within the surface of the heating chamber 51 such that the electrical resistance heating element 14 located at or near that position is visible via the opening 60. The optical assembly 55 comprises at least a backplane 54 having at least one optical sensor 56 attached thereto, a light blocking element 57 and a translucent filter 58. As illustrated in FIG. 5B, the translucent filter 58 is provided over the opening 60 of the connection port 59. The light blocking element 57 is provided over the translucent filter 58 and the backplane 54 is provided over the light blocking element 57 with the at least one optical sensor 56 of the backplane being placed on a side facing the light blocking element 57, translucent filter 58 and opening 60.

Figure 6:
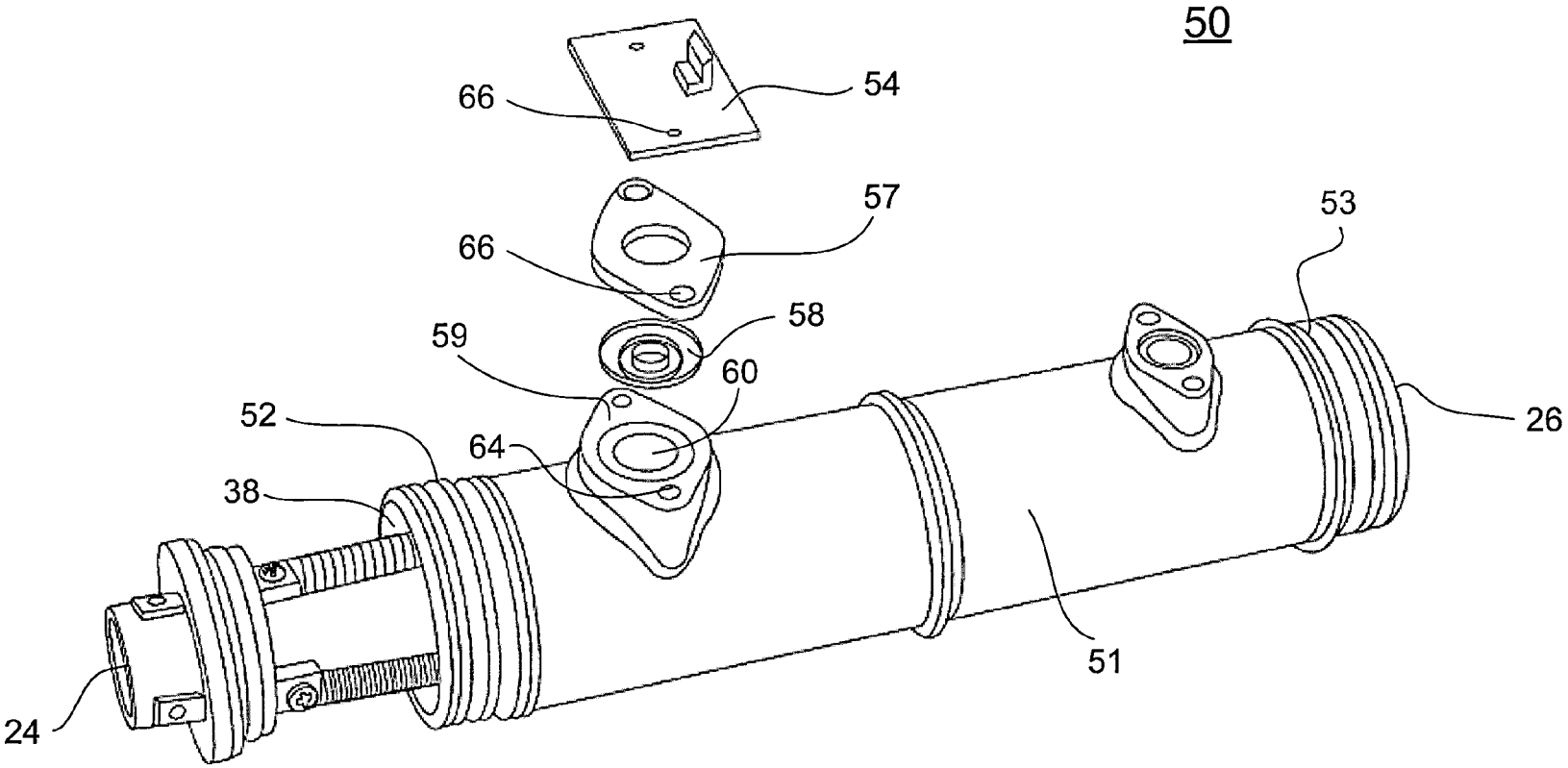
FIG. 6 is a three-dimensional view of the formation of the optical assembly on the heating chamber according to one example.

FIG. 6 illustrates a method of assembly of the system 50 and optical assembly 55 over a connection port 59 of the heating chamber 51. As illustrated in FIG. 6, the heating unit 1 having electrical resistance heating elements 14 is partially enclosed within the heating chamber 51 such that there is provided a flow channel 38 over the electrical resistance heating elements 14 between the tube 10 and heating chamber 51. In selected embodiments, liquid flow is externally directed into the flow channel 38 such that the liquid flows towards the inlet 26. The liquid is then externally directed into the inlet 26 through the tube 10 and out the outlet 24. Accordingly, liquids are efficiently heated by being energized both while flowing over the electrical resistance heating elements 14 and while flowing through the tube 10. In selected embodiments, the heating chamber 51 may fully enclose the heating unit 1 except for at the inlet 26 end such that fluid may come into the heating chamber 51 via the area surrounding the inlet 26 such that flow is directed around the electrical resistance heating elements 14 and into the inlet 26.

A plurality of connection ports are also illustrated in FIG. 6. Connection port 59 having an opening 60 is raised above an outer surface of the heating chamber 51. However, in selected embodiments, the connection port 59 may be flush with the outer surface of the heating chamber 51. The translucent filter 58 is placed over all or a portion of the connection port 59 and fully covers the opening 60. The translucent filter 58 is illustrated in FIG. 6 having a concave shape but can take any shape as would be recognized by one of ordinary skill in the art. The light blocking element 57 is then positioned over the translucent filter 58 as well as the connection port 59. The back plane 54 is then positioned over the light blocking element 57. As the optical sensor 56 is on a side of the backplane 54 facing the opening 60, the optical sensor 56 is on the lower side of the backplane 54 and is not visible in FIG. 6. At least one fastener location 64 is also provided within the connection port 59 such that corresponding fastening locations 66 of the light blocking element 57 and backplane 54 can be firmly affixed to the heating chamber 51.

The optical assembly 55 provides the heating system 50 with the ability to efficiently detect overheating of the electrical resistance heating elements 14. Under normal conditions, the electrical resistance heating elements 14 will not emit any visible light and will only emit heat energy. However, if at least one of the electrical resistance heating elements 14 is dry fired without the presence of a fluid or has been energizing stagnant fluids for extended periods, the electrical resistance heating element 14 will begin to emit light energy in the visible spectrum. For example, the electrical resistance heating element 14 may begin in this instance to emit a visible red, orange or yellowish glow. The optical sensor 56 is an optical sensor as would be recognized by one of ordinary skill in the art and is calibrated, selected and/or filtered such that the optical sensor 56 will detect light emitted from one or more overheating electrical resistance heating element 14. To reduce the amount of non-visible infrared emission from one or more of the electrical resistance heating elements 14 which could cause false readings by the optical sensor 56, at least one translucent filter 58 is provided as described herein which filters the infrared emission before it is detected by the optical sensor 56.

To prevent further false readings by the optical sensor 56, the light blocking element 57 is provided over a portion of the translucent filter 58 to prevent ambient light from entering the opening 60 of the heating chamber 51 between the heating chamber 51 and the translucent filter 58 and/or the translucent filter 58 and the backplane 54. Further, in selected embodiments, the heating chamber 51 may be molded or machined from an opaque material to further reduce the amount of ambient light that may enter an inner surface of the heating chamber 51. Additionally, in selected embodiments, the backplane 54 may consist of Printed Circuit Board (PCB) made of an opaque material to prevent ambient light from entering a backside of the PCB and affecting readings made by the optical sensor 56. Power is provided to the optical sensor 56 via the backplane 54 which is powered from an external source as would be understood by one of ordinary skill in the art.

The heating system 50 described above having a heating chamber 51 comprising an optical assembly 55 which can detect overheating of electrical resistance heating elements 14 of the enclosed heating unit 1 provides numerous advantages. At any point at which the optical sensor 56 detects visible light being emitted from at least one of the electrical resistance heating elements 14, a signal may be generated by the optical sensor 56 and processed by the PCB to transmit a signal to cut power to a specific overheating electrical resistance heading element 14 or to all the electrical resistance heating elements. Signals output from the optical sensor 56 may also be further filtered by software or hardware to ignore ambient light from external sources and limit detection and warning to light emitted by the electrical resistance heating elements 14 in a particular visible spectrum. Further, detecting overheating via the optical sensor 56 through the detection of light provides extremely high speed of light reaction times for shutting down one or more electrical resistance heating elements 14. Therefore, the heating system 50 can easily prevent damage to the electrical resistance heating elements 14 or other parts thereby increasing the longevity of the system as a whole and reducing cost for replacement parts.

It should be noted that while the description above with respect to FIGS. 1-6 describes various features of the heating unit 1 and heating system 50, numerous modifications and variations are possible in light of the above teachings. For example, each electrical resistance heating element 14 can be provided a different length and connected to the tube via a retention clip 22 at an indexed groove 18 different from that of other electrical resistance heating elements 14. Alternatively, each electrical resistance heating element 14 can be of a shorter length than that illustrated in FIGS. 1A-1C and attached to the same retention clip 22 at an indexed groove 18 closer to the flange 12. This allows the use of the same tube 10 to provide various configurations based on individual client needs, to provide optimized configurations for heat transfer based on particularities of various systems and to provide a "one size fits all" to lower production costs. Further, systems requiring less heat may employ fewer electrical resistance heating elements 14 whereas systems requiring more heat may employ additional electrical resistance heating elements.

Additional configurations are possible via design options for the heating chamber 51 such that the heating chamber 51 may be machined or molded with one or more connection ports 59 and openings 60. Accordingly, the heating chamber 51 may have connection ports 59 on various sides of the heating chamber 51 such that a plurality of electrical resistance heating elements 14 are visible through openings 60. Accordingly, a plurality of optical assemblies 55 may be affixed to the connection ports 59 to provide enhanced thermal detection and safety activation procedures to reduce the chances of damage to the electrical resistance heating elements 14. To provide the heating system 50 at a lower cost, fewer optical assemblies 55 may be used to detect light emitted from one or more electrical resistance heating elements 14. In this configuration, the optical sensor 56 may be configured to detect lower level amounts of visible light such that light emitted by overheating electrical resistance heating elements 14 on the opposite side of the connection port 59 of which the optical assembly 55 is attached may be detected. Further, in selected embodiments reflective optics may be placed on the outer surface of the tube 10 and/or an inner surface of the heating chamber 51 such that light emitted by overheating electrical resistance heating elements 14 is transmitted through the interior of the heating system 51 and/or magnified for enhanced detection by the optical sensor 56. In this configuration, cost may be saved as fewer optical assemblies may be required.

The components described above can be manufactured, in selected embodiments, via injection molding or machining as would be understood by one of ordinary skill in the art. Therefore, the tube 10 and heating chamber 51 may be molded into any shape or made from any material, such as thermoplastic or thermosetting polymers, as would be understood by one of ordinary skill in the art. Accordingly, common polymers such as epoxy, phenolic, nylon, polyethylene or polystyrene may be utilized. This material is fed into a heated barrel, mixed and forced into a mold cavity (formed of a material such as steel or aluminum and machined to a form that features the desired part) where it cools and hardens to the configuration of the cavity. Exemplary molding machines that may be utilized for such a process include a Ferromatik milcaron injection molding machine or those built by Arburg.

The components described above, such as the heating unit 1 and heating chamber 51, may be also be precision machined manually or automatically by computer numerical control (CNC) as would be understood by one of ordinary skill in the art. Accordingly, the components can be formed of metal, such as steel or aluminum, and formed via a combination of turning, drilling, milling, shaping, planning, boring, broaching and sawing.

The electrical resistance heating elements 14 can be made from any type of alloy as would be understood by one of ordinary skill in the art. For example, the electrical resistance heating elements 14 may consist of a high temperature resistance alloy such as nickel-chrome alloy or iron chrome aluminum alloy. These may be formed as coils as illustrated in FIGS. 1-6 or may be looped or sinuously wound around the tube 10. The electrical resistance heating elements 14 may be one continuous element, separate elements and sheathed or sheathless.

The optical sensor 56 in selected embodiments may be any electro-optical sensor as would be recognized by one of ordinary skill in the art. The optical sensor measures the physical quantity of light rays and converts this information into electronic signals which are process by the PCB. The translucent filter 57 may be any filter that can block infrared wavelengths but pass visible light as would be understood by one of ordinary skill in the art. For instance, the translucent filter may be an infrared cut-off filter or heat-absorbing filter which reflects or blocks infrared wavelengths while passing visible light.

Obviously, numerous modifications and variations of the present advancements are possible in light of the above teachings. It is therefore to be understood that within the scope of the appended claims, the present advancements may be practiced otherwise than as specifically described herein.

The invention claimed is:

1. A heating unit comprising:

a tube having a flange, and at least one indexed groove located along a length of the tube and forming a continuous recession within and across an outer surface circumference of the tube, wherein the at least one indexed groove contains a retention device; and at least one electrical resistance heating element positioned outside the at least one indexed groove and having a first end connected to the tube via the flange and a second end connected to the tube via the retention device, the at least one electrical resistance heating element being adjustable to be arranged in first and second configurations, wherein, in the first configuration, the retention device is positioned in the indexed groove such that a longitudinal axis of the heating element is parallel to the tube, and in the second configuration, the retention device is positioned in the indexed groove such that the longitudinal axis of the heating element is not parallel to the tube.

2. The heating unit according to claim 1, wherein the retention device is a clip and is removably attached to the tube.

3. The heating unit according to claim 1, wherein the flange includes a plurality of termination structures which each mechanically and electrically connect corresponding first ends of the at least one electrical resistance heating element to the tube.

4. The heating unit according to claim 1, wherein the tube includes a first opening on a first end and a second opening on a second end thereby providing a flow path therein.

5. The heating unit according to claim 1, wherein the retention device is adjustably rotatable around the circumference of the tube within the indexed grooves to provide different locations on the circumference of the tube at which to connect the at least one resistance heating element.

6. The heating unit according to claim 1, wherein the heating unit includes a plurality of indexed grooves at predetermined intervals along the length of the tube, the plurality of indexed grooves including the at least one indexed groove, and the at least one electrical resistance heating element extends along the length of the tube for a distance determined by which indexed groove contains the retention device for attaching the at least one electrical resistance heating element to the tube.

7. The heating unit according to claim 1, wherein the at least one electrical resistance heating element is attached to a surface of the retention device such that at least a portion of the at least one electrical resistance heating element is spaced apart from a surface of the tube.

8. A heating system comprising:

a tube having a flange, and at least one indexed groove located along a length of the tube and forming a continuous recession within and across an outer surface circumference of the tube, wherein the at least one indexed groove contains a retention device;

at least one electrical resistance heating element positioned outside the at least one indexed groove and having a first end connected to the tube via the flange and a second end connected to the tube via the retention device, the at least one electrical resistance heating element being adjustable to be arranged in first and second configurations; and a heating chamber that partially encloses the tube thereby creating a flow path therebetween, wherein, in the first configuration, the retention device is positioned in the indexed groove such that a longitudinal axis of the heating element is parallel to the tube, and in the second configuration, the retention device is positioned in the indexed groove such that the longitudinal axis of the heating element is not parallel to the tube.

9. The heating unit according to claim 8, wherein the retention device is a clip and is removably attached to the tube.

10. The heating unit according to claim 8, wherein the flange includes a plurality of termination structures which each mechanically and electrically connect corresponding first ends of the at least one electrical resistance heating element to the tube.

11. The heating unit according to claim 8, wherein the retention device is adjustably rotatable around the circumference of the tube within the indexed grooves to provide different locations on the circumference of the tube at which to connect the at least one resistance heating element.

12. The heating unit according to claim 8, wherein the at least one electrical resistance heating element is attached to a surface of the retention device such that at least a portion of the at least one electrical resistance heating element is spaced apart from a surface of the tube.

13. The heating system according to claim 8, wherein the heating chamber is made from an opaque material.

14. The heating system according to claim 8, wherein the heating chamber includes an optical assembly having at least one optical sensor to detect light emitted from the at least one electrical resistance heating element.

15. The heating system according to claim 14, wherein the heating chamber further includes an opening and the optical sensor is located above the opening to detect light emitted from the at least one electrical resistance heating element via the opening.

16. The heating system according to claim 15, wherein the optical assembly further includes a translucent filter connected to and covering the opening of the heating chamber such that the optical sensor detects light emitted through the translucent filter.

17. The heating system according to claim 16, wherein the optical sensor is affixed to a backplane made of an opaque material.

18. The heating system according to claim 17, wherein the optical assembly further includes a light blocking element attached to a portion of the translucent filter and the backplane to block light from entering between the backplane and the translucent filter.

19. The heating system according to claim 1, wherein the at least one electrical resistance heating element is positioned adjacent to the outer surface of the tube.

20. The heating system according to claim 1, wherein the tube has a continuous inner and outer surface circumference, and the continuous recession extends across an entirety of the continuous outer surface circumference of the tube.

21. The heating system according to claim 1, wherein the at least one indexed groove is closer to an axial center of the tube than the at least one electrical resistance heating element.

22. The heating system according to claim 1, wherein an entirety of the at least one electrical resistance heating element is positioned outside the at least one indexed groove.

23. A heating unit comprising:

a tube having a flange, and at least one indexed groove located along a length of the tube and forming a continuous recession within and across an outer surface circumference of the tube, wherein the at least one indexed groove contains a retention device; and at least one electrical resistance heating element positioned outside the at least one indexed groove and having a first end connected to the tube via the flange and a second end connected to the tube via the retention device, wherein the tube has a continuous outer surface circumference, the continuous recession extends across an entirety of the continuous outer surface circumference of the tube, an entirety of the at least one electrical resistance heating element is positioned outside the at least one indexed groove, the retention device is adjustably rotatable around the circumference of the tube within the indexed grooves to provide different locations on the circumference of the tube at which to connect the at least one resistance heating element, and the at least one electrical resistance heating element being linearly adjustable through the retention device so as to be at an angle with respect to a longitudinal axis of the tube.

* * * * *